United States Patent [19]

Tsubouchi et al.

[11] Patent Number: 4,822,250

[45] Date of Patent: Apr. 18, 1989

[54] APPARATUS FOR TRANSFERRING SMALL AMOUNT OF FLUID

[75] Inventors: Kuniyoshi Tsubouchi, Mito; Shohei Yoshida, Hitachi; Kiyoshi Namura, Ibaraki; Tsutomu Okusawa, Hitachi; Akira Arai, Tsukuba, all of Japan

[73] Assignee: Hitachi, Ltd., Tokyo, Japan

[21] Appl. No.: 198,223

[22] Filed: May 25, 1988

Related U.S. Application Data

[63] Continuation-in-part of Ser. No. 29,095, Mar. 23, 1987.

[30] Foreign Application Priority Data

Mar. 24, 1986 [JP] Japan ..... 61-64092
May 29, 1987 [JP] Japan ..... 62-131406

[51] Int. Cl.[4] ..... F04B 49/06
[52] U.S. Cl. ..... 417/45; 417/322
[58] Field of Search ..... 417/2, 45, 244, 322

[56] References Cited

U.S. PATENT DOCUMENTS

| | | | |
|---|---|---|---|
| 3,029,743 | 4/1962 | Johns | 417/322 |
| 4,311,436 | 1/1982 | Hendriks | 417/2 |
| 4,395,719 | 7/1983 | Majewski et al. | 417/322 X |
| 4,432,699 | 2/1984 | Beckman et al. | 417/322 X |
| 4,518,317 | 5/1985 | Inove | 417/45 |
| 4,626,180 | 12/1986 | Tagawa et al. | 418/63 |

FOREIGN PATENT DOCUMENTS

| | | | |
|---|---|---|---|
| 55-043258 | 3/1980 | Japan . | |
| 56-009679 | 1/1981 | Japan . | |
| 59-068578 | 4/1984 | Japan . | |
| 59-087286 | 5/1984 | Japan | 417/322 |
| 0588398 | 1/1978 | U.S.S.R. | 417/322 |

*Primary Examiner*—Carlton R. Croyle
*Assistant Examiner*—Eugene L. Szczecina, Jr.I
*Attorney, Agent, or Firm*—Antonelli, Terry & Wands

[57] ABSTRACT

An apparatus for transferring a small amount of fluid has at least one series of vibration pump units each having a fluid transfer pipe designed to perform a respirating action by the operation of a vibrator which vibrates in response to application of a high-frequency voltage. The fluid transfer pipes are connected in series via fluid diodes which serve to enable the fluid to flow only in one direction, while resisting reversing of the fluid, so that the fluid is transferred in one direction through the successive fluid transfer pipes. In order to minimize the pulsation of the fluid pressure at the downstream end of the apparatus, the vibrators of the pump unit are excited with predetermined phase differentials. Additional fluid diode is connected to the outlet end of the most downstream pump unit. The pressure differential across at least one of the fluid diodes is measured and the rate of transfer of the fluid performed by the fluid transfer apparatus is controlled in accordance with the measured pressure differential. In a specific form of the invention, a plurality of rows to of the vibration pump units are disposed in parallel, and the pressure differentials are measured across orifices provided on the downstream ends of the respective rows of the pump unit serieses deviations of the measured pressure differentials are detected. A control is preformed in accordance with the measured pressure differential deviations so as to equalize the flow rates of the fluid in all the parallel rows of vibration pump units.

7 Claims, 7 Drawing Sheets

APPARATUS FOR TRANSFERRING SMALL AMOUNT OF FLUID

CROSS-REFERENCE TO RELATED APPLICATION

This is a continuation in part of application Ser. No. 07/029,095 filed on Mar. 23, 1987.

BACKGROUND OF THE INVENTION

The present invention relates to an apparatus for transferring a small amount of fluid and, more particularly, to an apparatus for transferring small amount of fluid which includes at least one pump series which is composed of a plurality of vibration-type pumps which exhibit small pulsation of the pumped fluid and which afford easy control of flow rate of the pumped fluid. The apparatus of the present invention is suitable for use in apparatus or systems which handle small amounts of specimens which are generally expensive or difficult to obtain in large quantities, such as biological active substances, e.g., proteins, enzymes and cells. For instance, the fluid transfer apparatus of the present invention is suitable for use in bio-technological apparatus, medical apparatus and medical analyzers, space flight mission devices for life science such as free flow electrophoresis. The term "transfer of small amount of fluid" in this specification is used to mean the transfer of a fluid at a very small rate of, for example, 1 to 500 μl/min.

DESCRIPTION OF THE PRIOR ART

Various vibration type pumps have been proposed for the purpose of transferring small amounts of fluids, such as electromagnetic pump adapted for vibrating a diaphragm, and a pump in which, as disclosed in Japanese Patent Unexamined Publication No. 56-9679 or Japanese Patent Unexamined Publication No. 59-63578, a cylindrical vibration element is directly vibrated to displace a fluid.

All these known vibration type pumps rely upon a vibratory motion of a wall or a member for cyclically expanding or contracting a closed space to cause a cyclic change in volume thereby displacing or transferring a fluid. The vibration type pumps generally exhibit high reliability of operation and are capable of handling a corrosive or highly viscous fluids because they do not have any rotary or sliding part such as impeller or piston.

On the other hand, the vibration type pumps commonly suffer from a disadvantage that they essentially require check valves at the suction and delivery sides thereof for the purpose of preventing reversing of the pumped fluid, insofar as they make use of cyclic change in the internal volume. These check valves operate in response to the movement of the fluid so that a time delay is inevitably involved in the operation of the check valves. This undesirably draws a limit in the shortening of the period of the cyclic change in the volume, and causes a pulsation of the pressure of the pumped fluid. In particular, in the field which requires transfer of a small amount of fluid, the fluid-flow characteristic of the system to be supplied with the fluid tends to be adversely affected by the generation of pulsation. To avoid pulsation of the pressure of the pumped fluid, it is necessary to use a suitable pulsation prevention device such as an accumulator. Thus, the known vibration type pumps inconveniently suffer from problems in the view point of performance, construction and reliability. Moreover, in a pump system in which such vibration pumps are arranged in parallel with each other, the respective vibration pumps have different fluid transferring characteristics because the fluid transferring characteristic of each pump depends upon the dimensional accuracy and vibration characteristic of the pump. In the pump system of this class, therefore, it is very difficult to obtain uniformly controlled fluid transfer rates from all of the parallel pumps.

SUMMARY OF THE INVENTION

Accordingly, an object of the present invention is to provide an apparatus for transferring a small amount of fluid, which is improved to suppress generation of pulsation of the pressure of the fluid which is being transferred.

Another object of the present invention is to provide an apparatus for transferring a small amount of fluid, which is improved to enable a fluid to be stably transferred at a small rate.

A further object of the present invention is to provide an apparatus for transferring a small amount of fluid, which comprises a plurality of parallel rows of pump units each including a plurality of vibration pump units connected in series, the parallel rows of pump units sharing substantially equal proportions of the total rate of the fluid transfer.

According to one feature of the present invention, there is provided an apparatus for transferring a small amount of fluid, which includes at least one row of a plurality of vibration pump units connected in series. Each pump unit includes a fluid transfer pipe having fluid inlet and outlet ends. A vibrator surrounds the fluid transfer pipe to cause the same to make respiring vibration. An inner peripheral electrode is disposed between the fluid transfer pipe and the vibrator. An outer peripheral electrode is disposed on an outer periphery of the vibrator. A high-frequency voltage applying means is provided for applying a high frequency voltage across the inner and outer peripheral electrodes. An orifice means is disposed between each adjacent pair of pump units for allowing a fluid to flow easily from one of the pair of pump units into the other pump unit and exhibiting a resistance to a reversing flow of the fluid whereby the fluid is transferred from the one pump unit into the other pump unit. Additional orifice means is connected to the fluid outlet end of the most downstream pump unit. The high-frequency voltage applying means of respective pump units are controlled such that the vibrations of respective pump units are operated with a predetermined phase difference maintained between each adjacent pair of pump units to minimize pulsation of the fluid pressure at the fluid outlet end of the most downstream pump unit of the apparatus. The improvement according to the present invention comprises means for detecting a pressure differential across at least one of all of the orifice means to produce a differential pressure signal; and means for controlling the high-frequency voltage applying means to control the fluid transferring rate of the apparatus based on the differential pressure signal.

According to another feature of the present invention, there is provided an apparatus for transferring a small amount of fluid which includes a plurality of rows a vibration pump units connected in series. Each pump unit includes a fluid transfer pipe having fluid inlet and outlet ends, a vibrator surrounding the fluid transfer pipe to cause the same to make respiring vibration, inner peripheral electrode disposed between the fluid transfer pipe and the vibrator, an outer peripheral electrode disposed on an outer periphery of the vibrator, and a high-frequency voltage across the inner and outer peripheral electrodes. An orifice means is disposed between each adjacent pair of pump units of each row for allowing a fluid to flow easily from one of the pair of pump units to the other pump unit and exhibiting a resistance to a reversing flow of the fluid whereby the fluid is transferred from the one pump unit into the other pump unit. An additional orifice means is connected to the fluid outlet end of the most downstream pump unit of each row. A pressure differential detecting means is provided to detect a pressure differential across at least one of all of the orifice means of each row to produce a pressure differential signal. A further means is provided to detect a deviation of the pressure differential signal produced by the pressure differential detecting means of all of the rows to control the high-frequency voltage applying means of all of the rows such that the fluid transferring rates of all rows are substantially equalized.

The above and other objects, features and advantages of the present invention will become clear from the following description of the preferred embodiments when the same is read in conjunction with the accompanying drawings.

DESCRIPTION OF THE PREFERRED EMBODIMENTS

Figure 1:
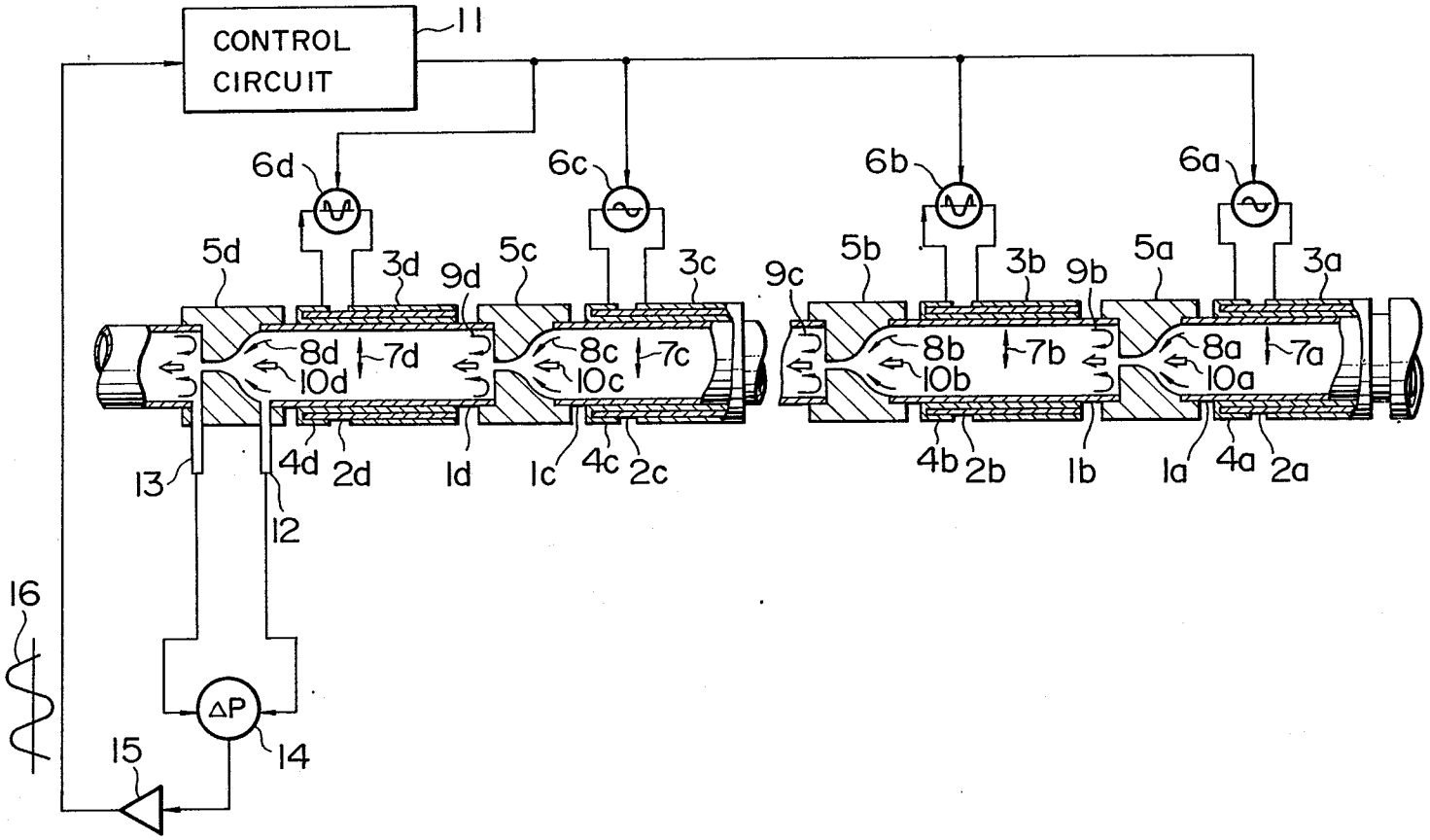
FIG. 1 is a schematic sectional view of an embodiment of the apparatus of the present invention for transferring a small amount of fluid.

An embodiment of the apparatus in accordance with the present invention for transferring a small amount of fluid will be described hereinunder with reference to FIG. 1 which is a sectional view of the apparatus and also to FIG. 2 which is a circuit diagram of a control circuit for controlling the operation of the apparatus shown in FIG. 1. Referring to FIG. 1, the apparatus has a fluid transfer passage having a plurality of cylindrical fluid transfer pipes 1*a* to 1*d* connected in series. These fluid transfer pipes 1*a* to 1*d* are respectively embraced by cylindrical vibrators 2*a* to 2*d* which fit on the outer peripheral surfaces of the respective pipes. These cylindrical vibrators are typically constituted by piezoelectric elements or electrostrictive elements. The vibrators 2*a* to 2*d* are surrounded by outer peripheral electrodes 3*a* to 3*d* in such a manner that the outer peripheral surface of each vibrator is not covered by the outer electrode at a portion adjacent to one axial end of each vibrator. In addition, inner electrodes 4*a* to 4*d* are provided such that these inner electrodes 4*a* to 4*d* lay on the outer peripheral surfaces of the vibrators 2*a* to 2*d* at the above-mentioned axial end portions which are not covered by the outer electrodes 3*a* to 3*d* and such that these inner electrodes covers the entire inner peripheral surfaces of the vibrators 2*a* to 2*d*. These electrodes are intended for causing respirating action, i.e., radial expansion and contraction, of the associated fluid transfer pipes by the vibration of the respective vibrators. The outer electrodes 3*a* to 3*d* and the inner electrodes 4*a* to 4*d* are insulated from each other. External high-frequency power supplies 6*a* to 6*d* are connected between the outer electrodes 3*a* to 3*d* and the corresponding inner electrodes 4*a* to 4*d*, respectively. Thus, the fluid transfer pipes 1*a* to 1*d*, the vibrators 2*a* to 2*d*, the outer electrodes 3*a* to 3*d*, the inner electrodes 4*a* to 4*d* and the power supplies 6*a* to 6*d* constitute respective vibration pump units. The fluid transfer pipes 1*a* to 1*d* are provided at their outlet ends with orifice means constituted by fluid diodes 5*a* to 5*d* which produce large flow resistance against reversing flow of the fluid. In the illustrated embodiment, although not exclusively, each of the fluid diodes 5*a* to 5*d* is of a flow-nozzle type which has an entrance end defined by a smooth curvature and an exit end which opens at an acute angle to pose a large resistance to reversing flow of the fluid.

In operation, a high-frequency voltage is applied across the outer electrodes 3*a* to 3*d* and the inner electrodes 4*a* to 4*d* on the respective vibrators 2*a* to 2*d* of the respective pump units. As a result, the vibrators 2*a* to 2*d* start to vibrate in the radial direction so as to cause respirating actions of the respective fluid transfer pipes 1*a* to 1*d*, i.e., radial expansion and contraction, as indicated by the double-headed arrows 7*a* to 7*d* in FIG. 1. As a result of the respirating actions, induction flow components 8*a* to 8*d* and 9*b* to 9*d* are generated in the respective fluid transfer pipes 1*a* to 1*d* along the inner peripheral surfaces of these pipes. The induction flow components 8*a* to 8*d* causes displacement of the fluid towards the fluid diodes 5*a* to 5*d* on the outlet ends of the respective fluid transfer pipes 1*a* to 1*d* because the entrance ends of the fluid diodes 5*a* to 5*d* are smoothly shaped to produce only a small flow resistance. On the other hand, the induction flow components 9*b* to 9*d*, which are directed towards the inlet ends of the respective fluid transfer pipes 1*a* to 1*d* encounter large flow resistance produced by the exit ends the fluid diodes on the outlet ends of the fluid transfer pipes immediately upstream thereof, because the exit ends of these fluid diodes form restricted openings having an acute angle as illustrated. In consequence, the induction flow components 9*b* to 9*d* are reflected and reversed so as to be directed towards the fluid diodes of the respective fluid transfer pipes 1*a* to 1*d*. In consequence, the fluid in each of the fluid transfer pipes 1*a* to 1*d* is displaced towards the fluid diode, as indicated by arrows 10*a* to 10*d*.

Suitable phase differentials are introduced between the high-frequency signals applied from the high-frequency power supplies 6*a* to 6*d* to the respective vibrators 2*a* to 2*d*. For instance, the high-frequency signals are applied by the respective power supplies 6a to 6d at phase differentials which are expressed as follows.

$A_0 \sin(\omega t)$
$A_1 \sin(\omega t+\alpha_1)$
$A_2 \sin(\omega t+\alpha_2)$
$A_3 \sin(\omega t+\alpha_3)$ where $A_0$ to $A_3$ represent amplitudes of vibration, $\alpha$ represents angular or circular vibration frequency, t represents time and $\alpha_1$ to $\alpha_3$ represents the phases. Thus, the fluid transfer pipe 1d which is on the upstream end of the pump unit series is vibrated, i.e., cylindrically expands and contracts as indicated by the arrow 7a, as represented by $A_0 \sin(\omega t)$. Similarly, the downstream fluid transfer pipes 1b to 1d make respirating actions 7b to 7d as represented by $A_1 \sin(\omega t+\alpha_1)$, $A_2 \sin(\omega t+\alpha_2)$ and $A_3 \sin(\omega t+\alpha_3)$, respectively. It is possible to accelerate the flow of the fluid induced in the series of fluid transfer pipes 1a to 1d and, in addition, to obtain a high discharge pressure at the downstream end of the pump unit series, while diminishing undesirable pulsation of the fluid pressure, by establishing optimal phase relations between the respirating actions 7a to 7d of the successive pump units, through a suitable selection of the phase differentials $\alpha_1$ to $\alpha_3$. To this end, the described embodiment employs a control circuit 11 which is capable of controlling the output levels, frequencies and phases of the high-frequency signals from the high-frequency power supplies 6a to 6d, upon detection of and in accordance with the pressure differential across at least one, e.g., 5d, of the plurality of fluid diodes 5a to 5d. The detection of the pressure differential is conducted by means of a pressure differential sensor 14 capable of sensing a very small pressure differential upon receipt of pressures derived from pressure measuring ports 12 and 13 communicating with the fluid passage on the upstream and downstream sides of the fluid diode 5d. The output from the pressure differential sensor 14 is input to an amplifier 15 so as to be amplified to form a pressure differential signal 16 which is input to the control circuit 11.

Figure 2:
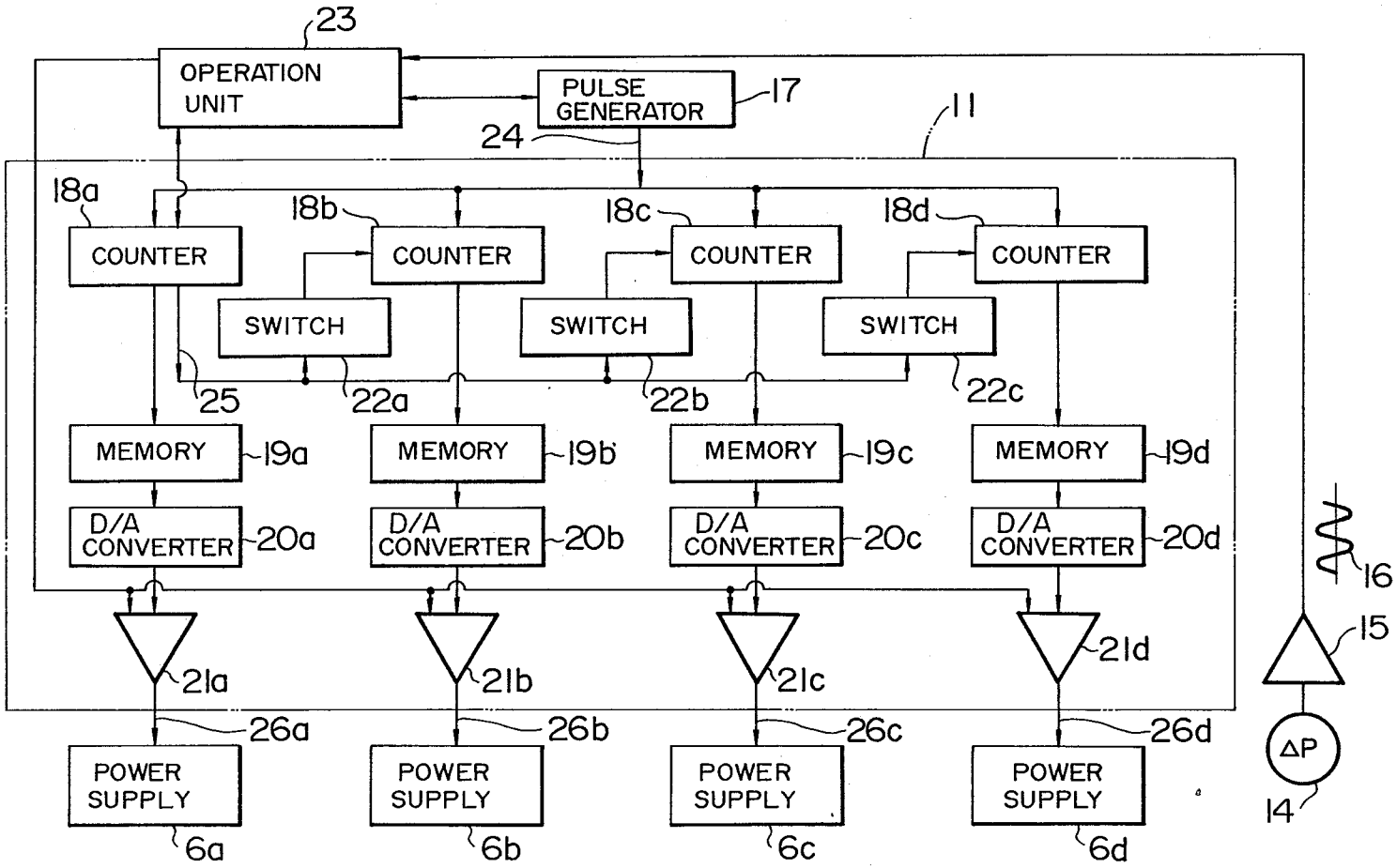
FIG. 2 is a circuit diagram of a control circuit for controlling the operation of the apparatus shown in FIG. 1.

FIG. 2 shows the practical circuit arrangement of the control circuit 11 shown in FIG. 1. This control circuit 11 is designed to cause vibration of the four fluid transfer pipes 1a to 1d at different phases as described. More specifically, the control circuit 11 is capable of digitally producing a plurality of, four in the illustrated case, high-frequency signals in response to the pressure differential signal 16 derived from the amplifier 15, and causing a plurality of, four in the illustrated case, vibrators to vibrate in accordance with these high-frequency signals. As shown in FIG. 2, the control circuit 11 includes a pulse generator 17 (clock) for generating clock pulses, a reference counter 18a, a subordinate counter 18b to 18d, memories 19a to 19d, D/A converters 20a to 20d, amplifiers 21a to 21d, digital switches 22a to 22c and an operation unit 23 for controlling these constituent elements. In the described embodiment, the vibration is caused by applying to the respective pump units sine-wave vibration signals having phase differentials. More specifically, the application of the sine-wave vibration signals is effected in a manner which will be explained hereinunder. Each of the memories 19a to 19d has $n_0$ bits of address which store digital data corresponding to one period of the sine-wave signal. Digital pulses 24 generated by the pulse generator 17 are counted by the reference counter 18a and subordinate counters 18b to 18d. The reference counter 18a is an $n_0$-notation counter which is capable of counting up to the value $n_0$ designated by the operation unit 23 and, after counting the value $n_0$, clearing the content to commence counting again from the initial value 1. The reference counter 18a, upon counting the value $n_0$, generates a synchronizing pulse 25 in accordance with which the subordinate counters 18b to 18d commence counting of the pulses from values $n_1$ to $n_3$ which are set by digital switches 22a to 22c in accordance with the instructions given by the operation unit 23.

The values $n_0$ to $n_3$ are determined to meet the condition represented by the following formula (1).

$$1 \leqq n_1 \leqq n_2 \leqq n_3 \ldots \leqq n_0 \quad (1)$$

Similarly to the reference counter 18a, the subordinate counters 18b to 18d are $n_0$-notation counters which are adapted to count up to $n_0$ and then to be reset to start counting again from the initial value 1. In consequence, a plurality of number serieses $\{a_i\}$, $\{b_i\}$, $\{c_i\}$ and $\{d_i\}$, are formed. The number series $\{b_i\}$ to $\{d_i\}$ are digital period number serieses which have phase differentials $n_1$ to $n_3$, respectively, with respect to the number series $\{a_i\}$ formed by the reference counter 18a. The count output from the reference counter 18a is considered in relation to time. The components $a_j$, $b_j$, $c_j$ and $d_j$ of the respective number series at a moment $t_j$ corresponds to the addresses in the respective memories 19a to 19d so that the memories 19a to 19d output and deliver digital waveform data which are beforehand stored in these memories and which correspond to the designated addresses. These digital waveform data are converted into analog signals 26a to 26d by the respective D/A converters 20a to 22d and are then amplified by means of the respective amplifiers 21a to 21d. Then, the high-frequency power supplies 6a to 6d are controlled in accordance with the amplified analog waveform data so as to energize the vibrators 2a to 2d. As will be seen from FIG. 3, the analog signals 26a to 26d are signals which have continuous sine waveforms and which are set at phases $\alpha_1$ to $\alpha_3$. As described before, the phase differentials $\alpha_1$ to $\alpha_3$ are controllable through suitably setting by means of the operation unit 23, the counting initial values $n_1$ to $n_3$ from which the counting operations are to be commenced by the respective subordinate counters 18b to 18d which are triggered by the synchronizing pulse signal 25 produced by the reference counter 18a. It is to be noted, however, that the following relationships exist between the phases $\alpha_1$ to $\alpha_3$ and the counting initial values $n_0$ to $n_3$:

$$\left.\begin{aligned} \alpha_1 &= 2\pi(n_0 - n_1)/n_0 \\ \alpha_2 &= 2\pi(n_0 - n_2)/n_0 \\ \alpha_3 &= 2\pi(n_0 - n_3)/n_0 \end{aligned}\right\} \quad (2)$$

It will thus be seen that the phases $\alpha_1$ to $\alpha_3$, i.e., the phase differences, can freely be varied by setting the values $n_1$ to $n_3$ by means of digital switches 22a to 22c.

In the described embodiment, the control circuit 11 is so designed that it operates the operation unit 23 to control the frequency of the pulses generated by the pulse generator 17, counting initial values $n_1$ to $n_3$ to be counted by the digital switches 22a to 22c, and the amplification factors of the amplifiers 21a to 21d in such a manner that the DC component $B_1$ and the AC component $B_0$ are maximized and minimized, respectively, in the following formula (3) which represents the waveform F of the pressure differential signal 16 representing the pressure differential across at least one 5*d* of the plurality of fluid diodes 5*a* to 5*d:*

$$F=B_0 \sin(\omega_b t+\beta)+B_1 \quad (3)$$

Figure 3:
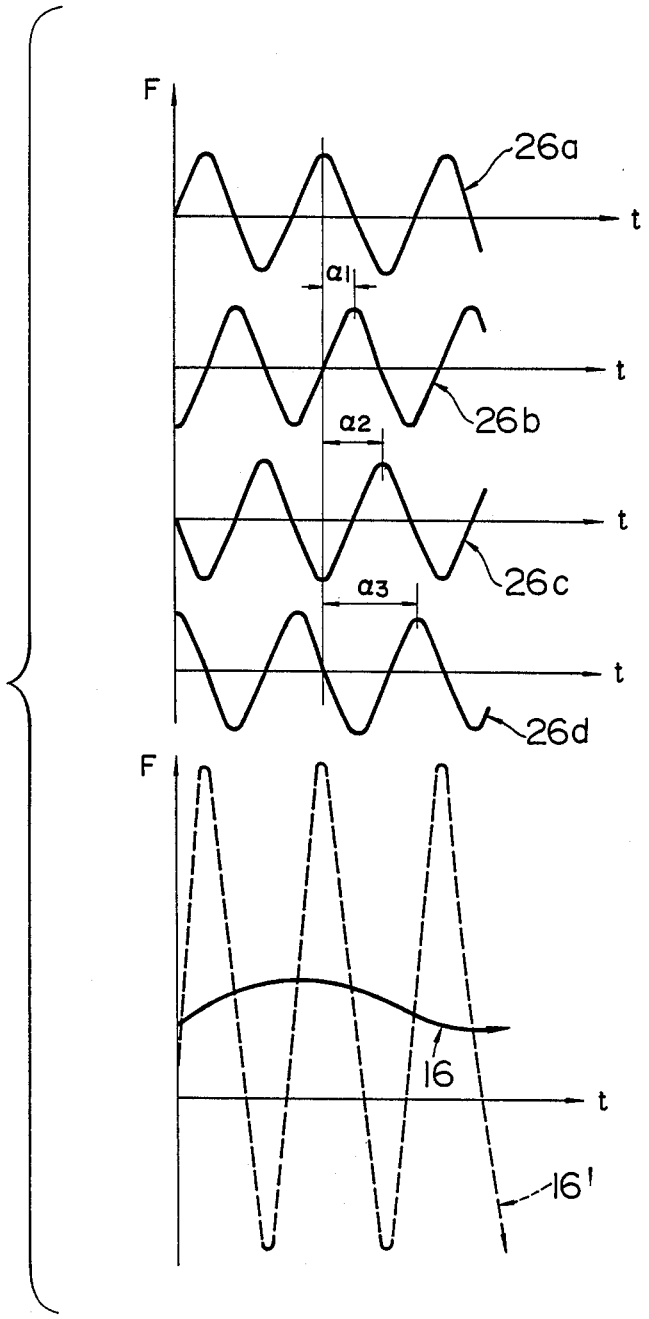
FIG. 3 is a graph showing operation characteristics of a vibrator in response to different vibration frequencies.

FIG. 3 shows the relationships between the analog signals 26*a* to 26*d* produced by the control circuit 11 shown in FIG. 2 and the waveform of the pressure differential signal indicative of the pressure differential across the fluid diode 5*d* sensed by the pressure differential sensor 14. It will be seen that a pressure differential signal 16 having a small vibration amplitude or a pressure differential 16′ having a large vibration amplitude are obtainable according to the values of the phase differentials.

The pressure differential signal 16 shown in FIG. 3 is obtained when the phase differentials $\alpha_1$ to $\alpha_3$ are selected to meet the condition of the following formula (4):

$$\alpha_3=3\alpha_1,\ \alpha_2=2\alpha_1,\ \alpha_1 \div \pi/2 \quad (4)$$

On the other hand, the pressure differential signal 16′ shown in FIG. 3 is obtained when the phase differentials $\alpha_1$ to $\alpha_3$ are selected to meet the condition of the following formula (5):

$$\alpha_1=\alpha_2=\alpha_3=0 \quad (5)$$

From FIG. 3, it will be understood that a fluid transfer apparatus which suffers from a small pulsation is obtained when the phase differentials $\alpha_1$ to $\alpha_3$ are selected to meet the condition given by the formula (4).

The fluid transferring effect is enhanced and, therefore, the rate of transfer of the fluid is increased when the phase differentials are selected to meet the condition given by the following formula (6):

$$\alpha_1=\alpha_2 \ldots =2\pi/N \quad (6)$$

where N represents the number of the fluid transfer pipes. This fact will be described in more detail with specific reference to FIG. 4.

Figure 4:
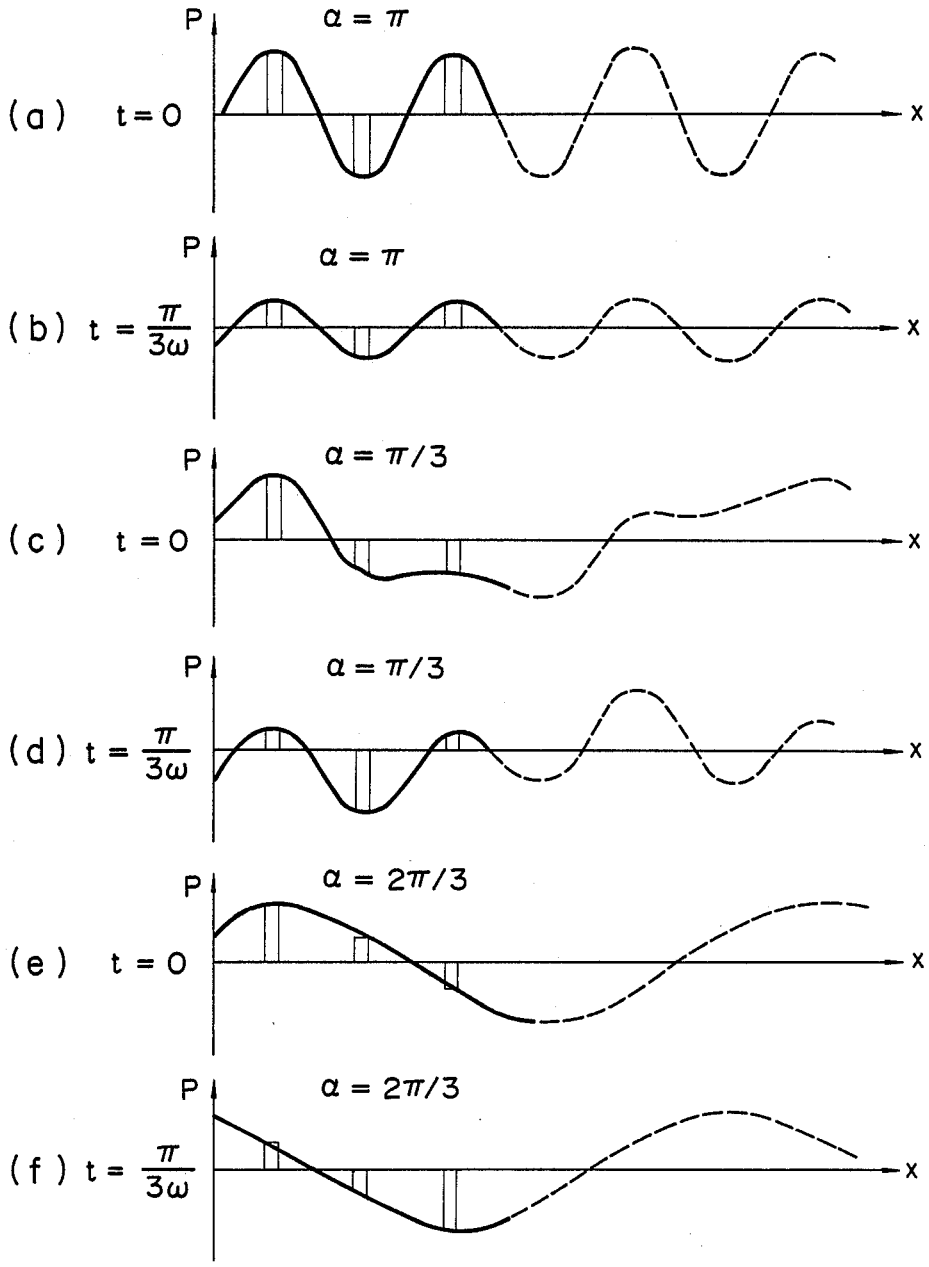
FIGS. 4A–4F are a graph showing patterns of pressure distribution in fluid transfer pipes as observed when the apparatus for transferring a small amount of fluid constituted by three transfer pipes is energized for vibration with three kinds of phase differential.

FIG. 4 illustrates the patterns of pressure distribution in the fluid transfer pipes in an apparatus embodying the invention and constituted by three pump units connected in series, in each of three cases: namely, curves (a), (b); (c), (d) and (e), (f) which are obtained with different values of the phase differentials. The broken-line curves in FIG. 4 show the patterns of the pressure distribution as observed in the piping connected to the downstream end of the fluid transfer apparatus. More specifically, curves (a) and (b), curves (c) and (d) and curves (e) and (f) in FIG. 4 represent the patterns of distribution of the fluid pressure in the direction of flow of the fluid as obtained at a moment $t=0$ and a moment $t=\pi/3\omega$, respectively, when the phase differential $\alpha$ is selected to be $\pi$, $\pi/3$ and $2\pi/3$, respectively. As will be seen from the curves (a) and (b), when the phase difference $\alpha$ is selected to be $\pi$, the fluid pressure in the apparatus exhibits such a distribution pattern that the nodes are fixed at the points of connection between the successive pump units. Namely, the fluid which is flowing through the apparatus exhibits a pressure pulsation of a frequency corresponding to the vibration frequency. In this case, therefore, the pulsation of the fluid pressure is not at all suppressed. In the second case where the phase differential $\alpha$ is selected to be $\pi/3$, the nodes of the pressure waveform proceed in the direction of flow indicated by X as will be seen from the curves (c) and (d). In this case, however, the pressure waveform vary in a random manner, so that this value of phase differential is not preferred from the view point of prevention of pressure differential. Referring now to the third case where the phase differential $\alpha$ is selected to be $2\pi/3$, the pressure waveform gently varies in the direction X of flow of the fluid as will be seen from the curves (e) and (f). Thus, the pressure wave in this case is a progressive wave having peaks progressively moved in the direction of flow. It will also be seen that the pulsation is appreciably suppressed in this case. From these facts, it is understood that the phase differential $\alpha$ is selected to be $2\pi/3$ when the apparatus is constituted by three pump units connected in series.

It will also be apparent to those skilled in the art that, when the apparatus includes more than three vibration pump units, the favorable effect as shown by the curves (e) and (f) in FIG. 4 is obtainable provided that the phase differential $\alpha$ is selected to meet the condition give by the formula (6).

It will thus be seen that the rate of transfer of the fluid can easily be controlled by varying the frequency and the amplitude of the pulses.

Figure 5:
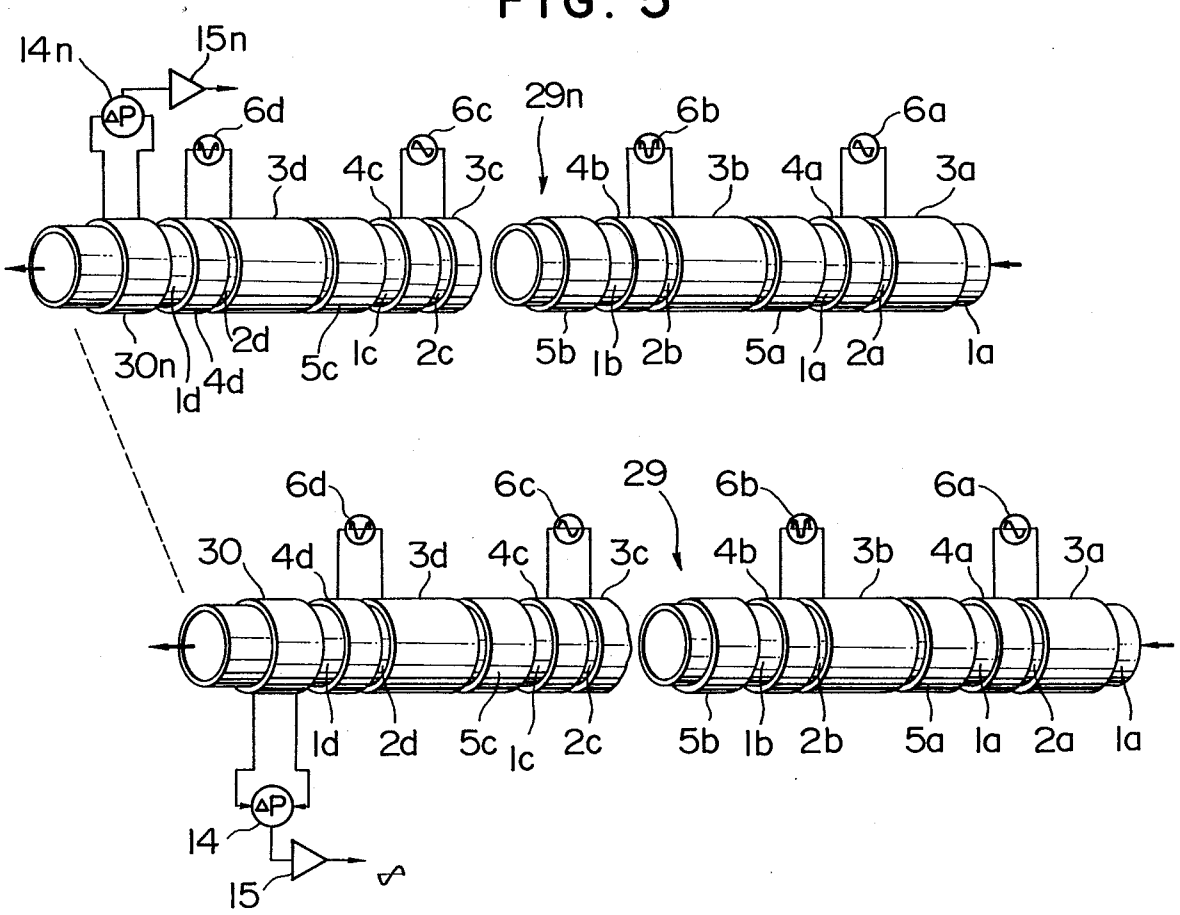
FIG. 5 is a schematic perspective view of another embodiment of the apparatus of the invention for transferring a small amount of fluid.
Figure 6:
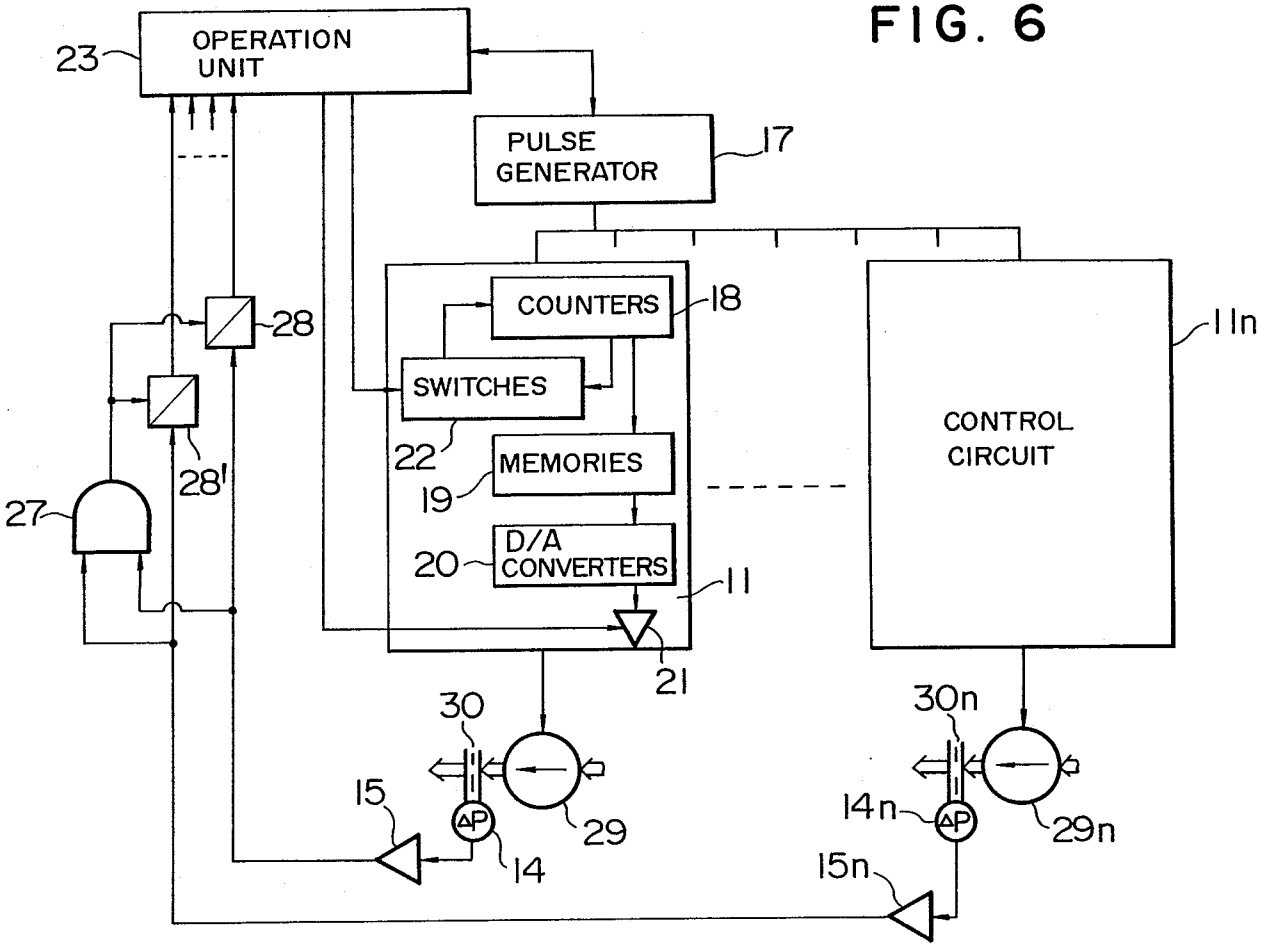
FIG. 6 is a circuit diagram of a control circuit for controlling the operation of the apparatus shown in FIG. 5.

FIGS. 5 and 6 show another embodiment of the apparatus in accordance with the present invention for transferring a small amount of fluid. This embodiment employs a plurality of serieses or rows 29 to 29*n* of pump units disposed in parallel, each series having a plurality of pump units of the type described above and connected in series. The major constituents of each series of pump units are materially the same as those in the pump unit series as shown in FIG. 5. In general, this type of apparatus encounters a difficulty in equalizing the flow rates of the transfer of fluid by all pump unit series. In this embodiment, the apparatus is controlled by a control circuit shown in FIG. 6 in such a manner that the flow rates of the fluid in all the pump unit serieses are equalized.

More specifically, the control circuit shown in FIG. 6 has a plurality of control circuits 11 to 11*n* each of which is similar to that described before in connection with FIG. 2. These control circuits 11 to 11*n* are connected to the pulse generator 17 which is the same as that explained before with reference to FIG. 2 and are capable controlling the plurality of serieses 29 to 29*n* of the pump units. The control circuit shown in FIG. 6 also has pressure differential sensors 14 to 14*n* which are capable of sensing the pressure differentials across the fluid diodes or orifice means 30 to 30*n* on the downstream ends of the respective serieses 29 to 29*n* of the pump units. The outputs from the respective pressure differential sensors 14 to 14*n* are input to and amplified by amplifiers 15 to 15*n*. The control circuit shown in FIG. 6 further has a mean processing unit 27 which computes the means value of the pressure differential signals derived from the respective serieses of pump units, and pressure differential deviation computing circuits 28 to 28*n* which compute and output deviations of the pressure differential signals from the respective amplifiers 15 to 15*n* from the mean of the pressure differentials computed by the mean processing unit 27. The thus determined pressure differential deviations are input to the operation unit 23. The operation unit 23 operates to control the respective serieses of the pump units independently of one another in accordance with the pressure differential deviation signals input thereto. It is thus possible to construct an apparatus having a plurality of pump unit serieses which are connected in parallel and each of which includes a plurality of pump units connected in series as shown in FIG. 1, while enabling the flow rates of the fluid in all the parallel pump unit serieses to be equalized without difficulty.

Figure 7:
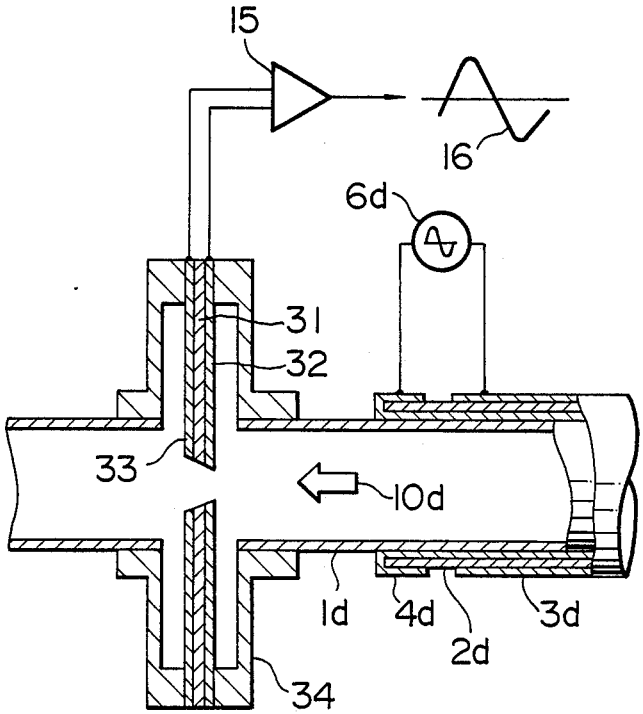
FIG. 7 is a sectional view of another example of a pressure differential sensor used in the apparatus shown in FIG. 1 and also in the apparatus shown in FIG. 5.

FIG. 7 shows a modification of the pressure differential sensor 14 which is used in each of the embodiments of FIGS. 1 and 5 for the purpose of sensing the pressure differential across the fluid diode. In the embodiments shown in FIGS. 1 and 5, the pressure differential sensor is designed to detect the pressure differential across at least one of the fluid diodes 5*a* to 5*d* annexed to the series of pump units. However, when the flow rate of the transferred fluid is small, only a small pressure differential is developed across the flow-nozzle type fluid diode, so that it is difficult to obtain high precision of detection of the pressure differential. In addition, the pressure measuring ports 12 and 13, through which the pressure differential sensor 14 is communicated with the upstream and downstream sides of the fluid diode 5*d* (see FIG. 1), produce damping effect to damp the vibration of the fluid pressure caused by the high-frequency vibrations of pump units, with the result that the frequency characteristics of the pressure differential waveform to be detected by the sensor 14 is impaired.

This problem, however, can be overcome by the modification shown in FIG. 7. Namely, in the modification shown in FIG. 7, a housing 34 having an internal space greater than that of the fluid transfer pipe 1*d* is connected to the fluid transfer pipe 1*d* at the outlet end thereof. An orifice plate 31 made of, for example, a piezoelectric element is provided in the housing. Electrodes 32 and 33, which are insulated from each other, are adhered to both sides of the orifice plate 31. These electrodes 32 and 33 are connected to an amplifier 15. Since the orifice plate 31 has an outer diameter greater than that of the fluid transfer pipe 1*d*, it can easily detect the waveform of vibration of the fluid 10 in the fluid transfer pipe 1*d*. In operation, a pressure differential of the fluid is formed across the orifice plate 10 and, at the same time, the orifice plate 31 defects in response to the pressure variation of the fluid 10*d* on the upstream side of the orifice plate 31. By constructing the orifice plate 31 from a vibrator element such as a piezoelectric element, therefore, it is possible to obtain a voltage of a level corresponding to the vibration amplitude. This voltage is picked up by the electrodes 32 and 33 and is input to the amplifier 15. It is thus possible to detect both the pressure differential across the orifice plate 31 and the cyclical variation of the pressure differential directly and with a high degree of accuracy. Therefore, the accuracy of control of the flow rate or flow rates performed by the embodiments shown in FIGS. 1 and 5 can be further improved when these embodiments are modified to employ the arrangement shown in FIG. 7.

What is claimed is:

1. In an apparatus for transferring a small amount of fluid, including:

at least one row of a plurality of vibration pump units connected in series, each pump unit including a fluid transfer pipe having fluid inlet and outlet ends, a vibrator surrounding said fluid transfer pipe to cause the same to make respiring vibration, an inner peripheral electrode disposed between said fluid transfer pipe and said vibrator, an outer peripheral electrode disposed on an outer periphery of said vibrator, and a high-frequency voltage applying means for applying a high frequency voltage across said inner and outer peripheral electrodes:

an orifice means disposed between each adjacent pair of pump units for allowing a fluid to flow easily from one of the pair of pump units into the other pump unit and exhibiting a resistance to a reversing flow of the fluid whereby the fluid is transferred from said one pump unit into the other pump unit; and an additional orifice means connected to the fluid outlet end of the most downstream pump unit;

the high-frequency voltage applying means of respective pump units being controlled such that the vibrators of respective pump units are operated with a predetermined phase difference maintained between each adjacent pair of pump units to minimize pulsation of the fluid pressure at the fluid outlet end of the most downstream pump unit of the apparatus, the improvement which comprises:

means for detecting a pressure differential across at least one of all of said orifice means to produce a differential pressure signal; and means for controlling said high-frequency voltage applying means to control the fluid transferring rate of the apparatus based on said differential pressure signal.

2. A fluid transferring apparatus according to claim 1, wherein said pressure differential detecting means is arranged to detect the pressure differential across said additional orifice means.

3. A fluid transferring apparatus according to claim 1, wherein said additional orifice means comprises an orifice plate of a piezoelectric material formed therein with an orifice, said orifice plate being deformable and vibrated by a pressure differential across said orifice to produce an electric voltage signal variable dependent on the amplitude of the vibration of said orifice plate, and wherein said controlling means comprises an electric controlling circuit responsive to said electric voltage signal to control the fluid transferring rate of the apparatus.

4. An apparatus for transferring a small amount of fluid, including:

a plurality of rows of vibration pump units connected in series, each pump unit including a fluid transfer pipe having fluid inlet and outlet ends, a vibrator surrounding said fluid transfer pipe to cause the same to make respiring vibration, an inner peripheral electrode disposed between said fluid transfer pipe and said vibrator, an outer peripheral electrode disposed on an outer periphery of said vibrator, and a high-frequency voltage applying means for applying a high frequency voltage across said inner and outer peripheral electrodes;

an orifice means disposed between each adjacent pair of pump units of each row for allowing a fluid to flow easily from one of the pair of pump units into the other and exhibiting a resistance to a reversing flow of the fluid whereby the fluid is transferred from said one pump unit into the other pump unit;

an additional orifice means connected to the fluid outlet end of the most downstream pump unit of each row;

means for detecting a pressure differential across at least one of all of said orifice means of each row to produce a pressure differential signal; and means for detecting a deviation of the pressure differential signals produced by the pressure differential detecting means of all of said rows to control the high-frequency voltage applying means of all of said rows such that the fluid transferring rates of all rows are substantially equalized.

5. A fluid transferring apparatus according to claim 4, wherein said pressure differential detecting means of each row is arranged to detect the pressure differential across said additional orifice means.

6. A fluid transferring apparatus according to claim 4, wherein said additional orifice means comprises an orifice plate of a piezoelectric material formed therein with an orifice, said orifice plate being deformable and vibrated by a pressure differential across said orifice to produce an electric voltage signal variable dependent on the amplitude of the vibration of said orifice plate, and wherein said controlling means comprises an electric controlling circuit responsive to said electric voltage signal to control the fluid transferring rate of the apparatus.

7. A fluid transferring apparatus according to claim 4, further including means for controlling the high-frequency voltage applying means of respective pump units of each row such that the vibrators of respective pump units are operated with a predetermined phase difference maintained between each adjacent pair of pump units of each row to minimize pulsation of the fluid pressure at the fluid outlet end of the most downstream pump unit of the row.

* * * * *